US006817150B1

(12) United States Patent
Boeshart

(10) Patent No.: US 6,817,150 B1
(45) Date of Patent: Nov. 16, 2004

(54) FORM SYSTEM FOR POURED CONCRETE

(76) Inventor: Patrick E. Boeshart, 3446 Glen Oaks Blvd., Sioux City, IA (US) 51104

( * ) Notice: Subject to any disclaimer, the term of this patent is extended or adjusted under 35 U.S.C. 154(b) by 0 days.

(21) Appl. No.: 10/392,521

(22) Filed: Mar. 20, 2003

(51) Int. Cl.[7] ..... E04C 1/00

(52) U.S. Cl. ..... 52/309.6; 52/309.7; 52/309.12; 249/29; 249/30; 249/83; 249/102

(58) Field of Search ..... 52/309.6, 309.7, 52/309.12, 783.1, 319–328, 415, 419, 421, 422, 424, 425, 434, 437–439; 249/29–30, 102, 83

(56) References Cited

U.S. PATENT DOCUMENTS 825,284 A * 7/1906 Dillon ..... 249/29
3,382,637 A * 5/1968 Longinotti ..... 52/320
4,206,267 A * 6/1980 Jungbluth ..... 428/623
4,372,901 A * 2/1983 Kim ..... 264/46.5
4,517,782 A * 5/1985 Shamszadeh ..... 52/309.7
4,841,702 A * 6/1989 Huettemann ..... 52/309.12
4,942,707 A * 7/1990 Huettemann ..... 52/259
5,172,532 A * 12/1992 Gibbar, Jr. ..... 52/309.12
5,381,635 A * 1/1995 Sanger ..... 52/251
6,272,749 B1 8/2001 Boeshart et al.
6,408,594 B1 * 6/2002 Porter ..... 52/794.1
6,550,215 B1 * 4/2003 Pulte et al. ..... 52/781.5

FOREIGN PATENT DOCUMENTS

WO WO 98/16703 4/1998

* cited by examiner

*Primary Examiner*—Jeanette E. Chapman

(57) ABSTRACT

A concrete form panel system includes a basic form panel of expanded polystyrene material having at least one slot formed in the top surface along its length, to divide the panel top surface into piers. A series of top hats are provided for selective attachment to the piers to increase the depth of the slots between piers, and thereby increase the depth of a joist formed by hardened concrete poured into the slot. Transverse slots may also be formed by separating top hats along their lengths. The transverse slots create transverse bracing between T-joists in a concrete deck. The form panels and top hats may also be used to create separate structural joists with attachment lifts, to permit connection of the joists to a subsequently constructed floor or deck system.

20 Claims, 5 Drawing Sheets

FORM SYSTEM FOR POURED CONCRETE

CROSS-REFERENCES TO RELATED APPLICATIONS (Not applicable)

STATEMENT AS TO RIGHTS TO INVENTIONS MADE UNDER FEDERALLY SPONSORED RESEARCH AND DEVELOPMENT (Not applicable)

BACKGROUND OF THE INVENTION (1) Field of the Invention

The present invention relates generally to forms for poured concrete roof and floor decks, and more particularly to an improved form system with attachable segments for on-site custom adjustment of the depth of concrete structural joists that may be integrated into the concrete deck formed by the forms or otherwise used as structural supports.

(2) Background Information

It is well known in the construction industry to utilize expanded plastic material for forms used in the construction of poured concrete walls and the like. In the formation of walls, the expanded plastic forms may either be removed once the concrete has hardened, or left in place to provide thermal and sound insulation to the completed structure.

A relatively recent innovation in the field of expanded plastic forms is disclosed in PCT patent application No. PCT/EP 97/05671, owned by Plastedil S. A. of Switzerland. That application discloses a self-supporting construction element made of expanded plastic material which is extruded with steel studs embedded therein. Each panel is molded with a steel stud imbedded therein during the molding process. The panels may then be cut to a desired length and interconnected to form a floor upon which concrete may be cast. A lath for supporting at least one layer of a covering material is fastened to the reinforcing bar in the panel, the lath providing fire resistant properties to the panel.

While the Plastedil forms provided a new system for forming cast in place concrete decks, the equipment needed to mold the plastic panel with the steel reinforcing bar therein was expensive and complicated. Because of the expense and time involved in creating the panels, the cost of using the system could be prohibitively expensive.

The applicant herein improved on this system by providing a method of manufacturing the form panels which made the production of the components simple and much more cost efficient. This improvement was the subject of applicant's U.S. Pat. No. 6,272,749, the disclosure of which is incorporated herein by reference thereto.

While the patented method provided less expensive form panels, it was still necessary to mold form panels in a variety of different thicknesses to form decks with joists of different depths to thereby accommodate spans of different lengths. Thus, it was required to stock a variety of different form thicknesses to insure that the appropriate thickness was available for a particular job. In the alternative, a predetermined number of panels of each particular thickness of form would have to be individually ordered and molded for a particular job. These panels typically could not be interchanged with one another at the job site, so it would be necessary to return and re-order panels if the job changed or any of the panels was damaged.

In addition, the existing form system did not provide for additional cross-bracing or other transverse structural strength. Thus, the use of the forms was limited to those jobs that did not require this additional transverse structural strength.

Another problem with prior art forms was the fact that the forms could not be removed once the concrete was poured and hardened, requiring the forms to be left in place. In addition, prior art forms were designed for use solely with an integrated concrete deck, and did not provide for the use of the forms to create joists that could be utilized as separate structural members for a structure.

BRIEF SUMMARY OF THE INVENTION

It is therefore a general object of the present invention to provide an improved form panel system for the creation of poured concrete joists used in the support of decks and roofs.

A further object of the present invention is to provide a system of form panels that may be adjusted on-site for the creation of a variety of joist depths for a particular job.

Yet another object is to provide an improved form system that permits the creation of transverse joists in the deck.

These and other objects will be apparent to those skilled in the art.

The improved form panel system of the present invention includes a basic form panel of expanded polystyrene material having at least one slot formed in the top surface along its length, to divide the panel top surface into piers. A series of top hats are provided for selective attachment to the piers to increase the depth of the slots between piers, and thereby increase the depth of a T-joist formed by hardened concrete poured into the slot and over the top of the panels. The form system thereby creates a concrete deck with integrated concrete joists for supporting the deck. Transverse slots may also be formed by separating top hats along their lengths. This, in turn, creates transverse bracing in the concrete deck for additional strength in the transverse direction. The form panels and top hats may also be used to create separate structural joists with attachment lifts, to permit connection of the joists to a subsequently constructed floor or deck system. The subsequent floor or deck need not necessarily be a concrete deck.

BRIEF DESCRIPTION OF THE SEVERAL VIEWS OF THE DRAWING

The preferred embodiment of the invention is illustrated in the accompanying drawings, in which similar or corresponding parts are identified with the same reference numeral throughout the several views, and in which.

DETAILED DESCRIPTION OF THE INVENTION

Figure 1:
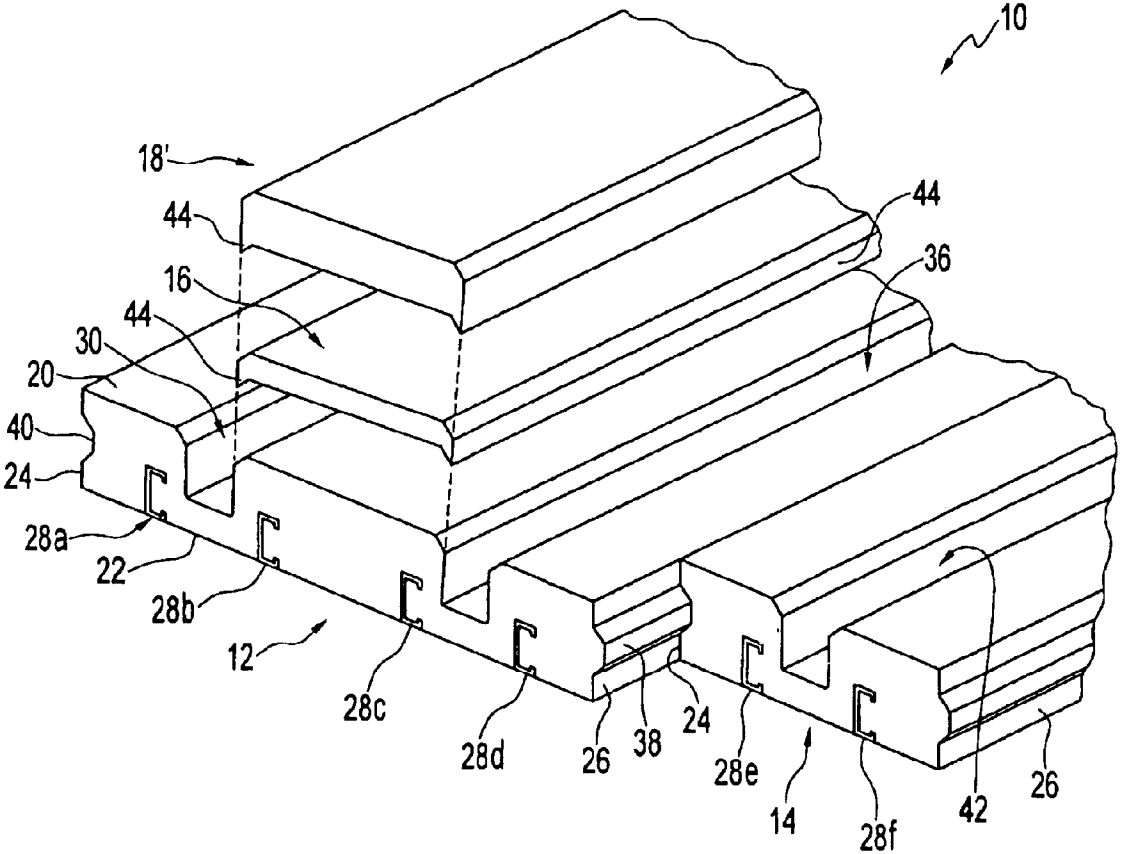
FIG. 1 is a perspective view of a portion of the form panel system of the present invention, with two top hats shown in exploded form for clarity.

Referring now to the drawings, in which similar or corresponding parts are identified with the same reference numeral, and more particularly to FIG. 1, the form system of the present invention is designated generally at 10, and shows one end of a basic form panel 12 and a half-width form panel 14, with two different sizes of top hats 16 and 18 exploded from the central section of form panel 12. Form panels 12 and 14 are interconnected to form a continuous floor upon which concrete is poured and permitted to harden to form a continuous, insulated concrete deck for roofs and floors.

Each form panel 12 is formed from expanded polystyrene modified bead material and includes a flat top face 20 and parallel bottom face 22. In the preferred embodiment, the polystyrene bead has a nominal density of 1.25 pounds. The typical panel 12 will have a depth, as measured from the top face to the bottom face, of about 6 inches, and a width measured from longitudinal side edge 24 to the opposing side edge 26, of 4 feet. The length of each panel can be adjusted to the desired dimension of the job requirement by simply cutting any excess length from the panel.

Each panel 12 includes a plurality of C-shaped steel channel studs 28 extending from end to end, parallel to one another and side edges 24 and 26. Studs 28 are uniformly spaced apart and have one leg of the channel exposed substantially flush with the lower face 22 of the panel 12. Preferably, studs 22 are 18-gauge steel and spaced about 12 inches on center.

Figure 3:
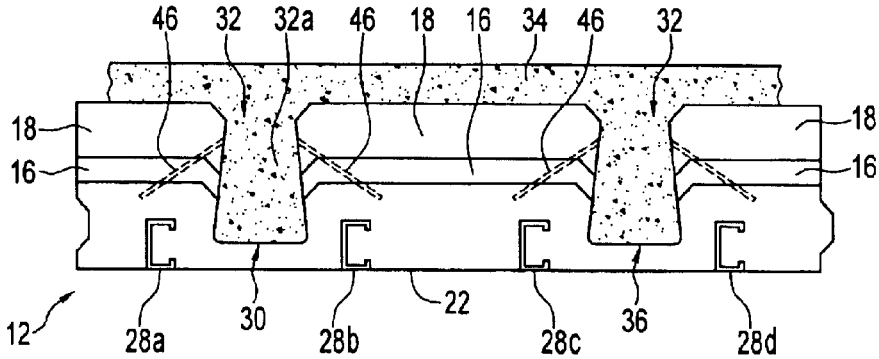
FIG. 3 is an end elevational view of the form panel shown in FIG. 2, with concrete poured in place on the form.

A longitudinal slot 30 is formed in the top face of panel 12 and extends from end to end in the panel generally centrally between the left two studs 28*a* and 28*b*. In a six-inch depth panel 12, slot 30 has a depth of about 4 inches and a width of about 6 inches at the upper edges of the slot. In the first embodiment, the width of slot 30 increases from the upper edges to the bottom, such that the width of the bottom of the slot 30 has a width of about 6 5/16 inches. Slot 30 will receive concrete to form the stem 32*a* of a T-shaped concrete joist 32, as shown in FIG. 3. A minimum 2 inch thick layer of concrete 34 is poured over the top of the forms to integrally connect the T-joists 32 and form a concrete deck with built-in structural support. Because the width of the slot increases from top to bottom, the concrete within the slot will retain the forms in position once the concrete has hardened in position, in the first embodiment of the invention 10.

Referring once again to FIG. 1, it can be seen that a second slot 36 is provided in the top face 20 of panel 12, centered between the right two studs 28*c* and 28*d*. Slot 36 is located parallel to slot 30, and has identical dimensions and shape. Thus, each panel 12 has a pair of slots 30 and 36, with land piers formed on each side of the slots.

The longitudinal edges 24 and 26 of panel 12 are provided with corresponding tongue and groove 38 and 40 respectively, along their lengths. In this way, adjacent panels will engage one another with corresponding tongue and groove, to align the panels and form a flush top face to support a layer of concrete.

Panel 14 is essentially one-half of a basic panel 12, with a single slot 42 formed in the top face 20, centered between two studs 28*e* and 28*f* in the lower face 22. Studs 28*e* and 28*f* are spaced apart 12 inches, the same as studs 28*a*–28*d* in panel 12, and are spaced 6 inches from each longitudinal edge 24 and 26 of panel 14. The outer-most studs 28*a* and 28*d* of panel 12 are also 6 inches from the longitudinal edges, so that all of the studs 28*a*–28*f* are 12 inches on center and the slots 30, 36 and 42 are 24 inches on center, when panels 12 and 14 are connected.

The upper edges of each slot 30, 36 and 42 are beveled along their lengths, to assist in directing concrete into each of the slots.

As discussed above, each particular structure has a predetermined distance to be spanned by the deck to be formed by panels 12 and 14. Depending upon the distance to be spanned, the depth of the slots 30, 36 and 42 will vary, to form a concrete joist of the desired depth (as measured along the length of the stem of the "T"). Thus, a greater depth of slot is required to form a greater depth joist, so as to span a greater distance. To provide a greater slot depth, the consumer was required to purchase panels 12 and/or 14 of a greater thickness. This in turn required the manufacturer of panels to keep panels of various thicknesses in stock, for a variety of different jobs. This also forced the manufacturer to invest in equipment to make the panels in varying thicknesses.

The inventor herein has developed a system of "top hats" 16 and 18 which are quickly and easily added to the piers of a basic panel 12 or 14 to increase the thickness of the panel without requiring the panel to be formed of the final desired thickness. Hats 16 and 18 are elongated flat sheets of expanded polystyrene modified bead, having a nominal density of about 0.7 pounds. The width of hats 16 and 18 is identical, and matches the width of the pier of panel 12 between slots 30, to rest directly on top of the panel between the slots 30 and 36 or between slots 36 and 42. The edges of each hat 16 and 18 have depending angles flanges 44 along their lengths that match the bevels on the upper edges of the slots 30, 36 and 42, to "nest" on top of the panel central pier between the slots. Likewise, each hat 16 and 18 has upper longitudinal edges that are beveled along their lengths, the same as the beveled edges of the slots.

It can therefore be seen that hats 16 and 18 have identical shapes, and will nest one atop the other or directly on top of the panel pier. The only difference between hat 16 and hat 18 is the thickness of the sheet of expanded polystyrene material from which each is formed. Preferably, hat 16 has a thickness of 2 inches and hat 18 has a thickness of 4 inches. The inventor also provides a third hat (not shown) having a thickness of 6 inches. One or more of the hats may be used alone or in combination, thereby providing the consumer with possible joist depths from 6 inches (using no hats) to 16 inches (using all three thicknesses of hats) in 2 inch intervals. All of these various thicknesses of panels are provided using a single thickness of basic panel 12.

Figure 2:
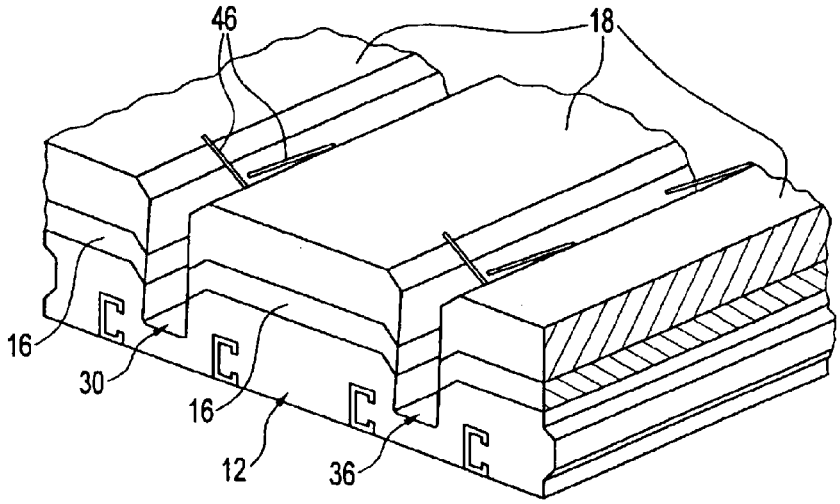
FIG. 2 is a view similar to FIG. 1, but with only a single form panel shown, the top hats in fixed position, and connection skewers shown in exploded form.

Referring now to FIGS. 2 and 3, a basic panel 12 is shown with a thin hat 16 and a medium thickness hat 18 in position on basic panel 12. Hats 16 and 18 are secured in position on the piers of panel 12 with a series of lengths of heavy wire 46 inserted diagonally though the hats 16 and 18 and in the base panel 12. In FIG. 2, the wire skewers are shown only partially inserted into the hats 18, prior to be installed completely into the base panel 12. In FIG. 3, skewers 46 are fully inserted.

While the preferred embodiment discloses the use of skewers 46 to secure hats 16 and 18 to base panel 12, other methods of securement are acceptable. For example, continuous application of glue or double-sided tape may also be used to anchor hats 16 and 18 in position.

Figure 4:
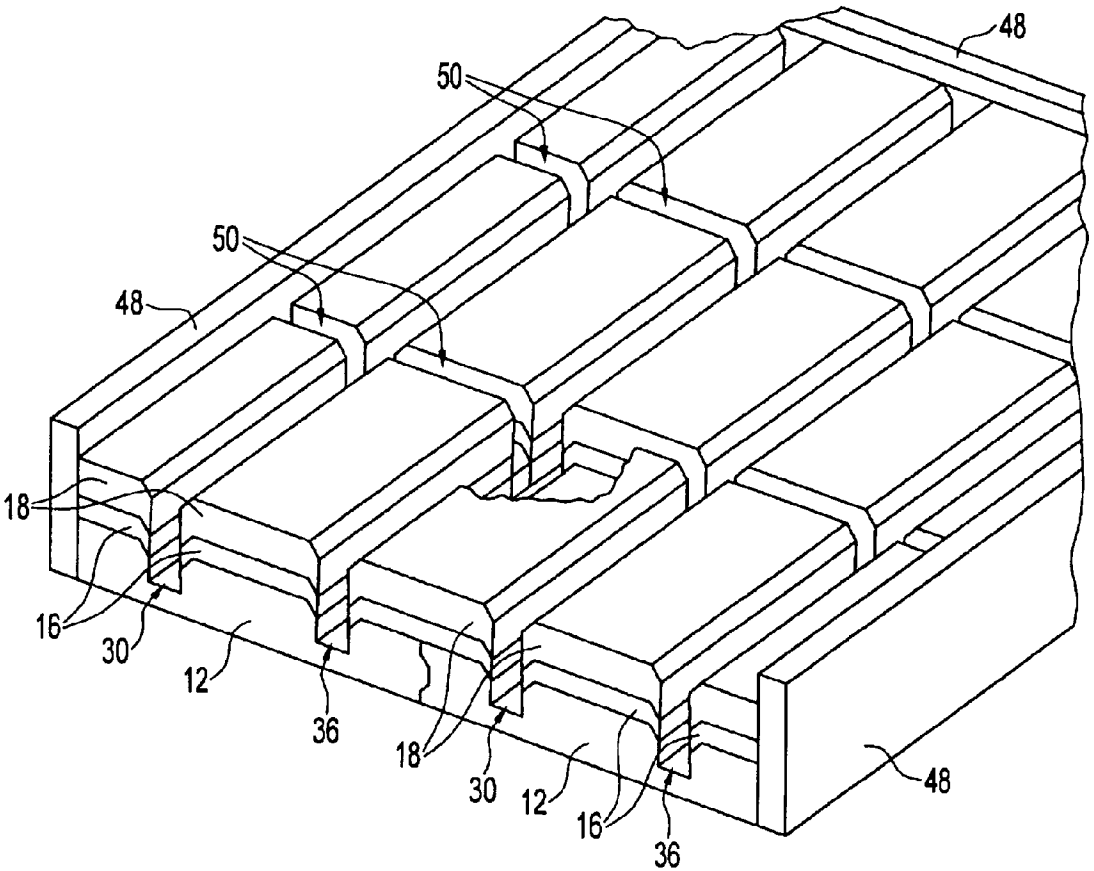
FIG. 4 is a perspective view of a portion of the form panel system with crosscuts made to form transverse structural members in the deck.

Referring now to FIG. 4, the form system of the present invention is shown set up with perimeter panels 48 in position, ready to receive concrete. A pair of base panels 12 serve as the base for the forms, with two top hats 16 and 18 secured in position on each side of slots 30 and 36 in each panel 12, to create a space for a T-joist having a depth of 10 inches (4" in the base panel, 2" in top hat 16 and 4" in top hat 18). Perimeter panels 48 extend upward past the top surface of hats 18 by at least 2 inches, to form the border for the depth of the poured concrete deck over the top of the form system 10.

Steel reinforcing rod (not shown) is placed in the slots and over the top surface of the form panels of the form system, as required for structural support of the poured concrete, although these rods are not shown in the drawings. Similarly, supports (not shown) under the entire form system 10 are used to hold the form panels 12 during the pouring and hardening of the concrete. Once the concrete has hardened and cured, the underlying supports (not shown) may be removed so that the concrete deck is self-supporting, using the integral T-joists formed by the slots in the panels.

FIG. 4 also demonstrates how the top hats 16 and 18 may be arranged so as to form transverse structural bracing in the concrete deck to be formed. Hats 16 and 18 are either formed or cut to lengths shorter than the overall length to be spanned by panels 12. Hats 16 and 18 are then spaced apart to form transverse slots 50, as shown in FIG. 4. These transverse slots 50 will form transverse T-joists between the longitudinal T-joists formed by slots 30 and 36, to create a coffer or waffle pattern that provides transverse structural strength to the deck.

Figure 5:
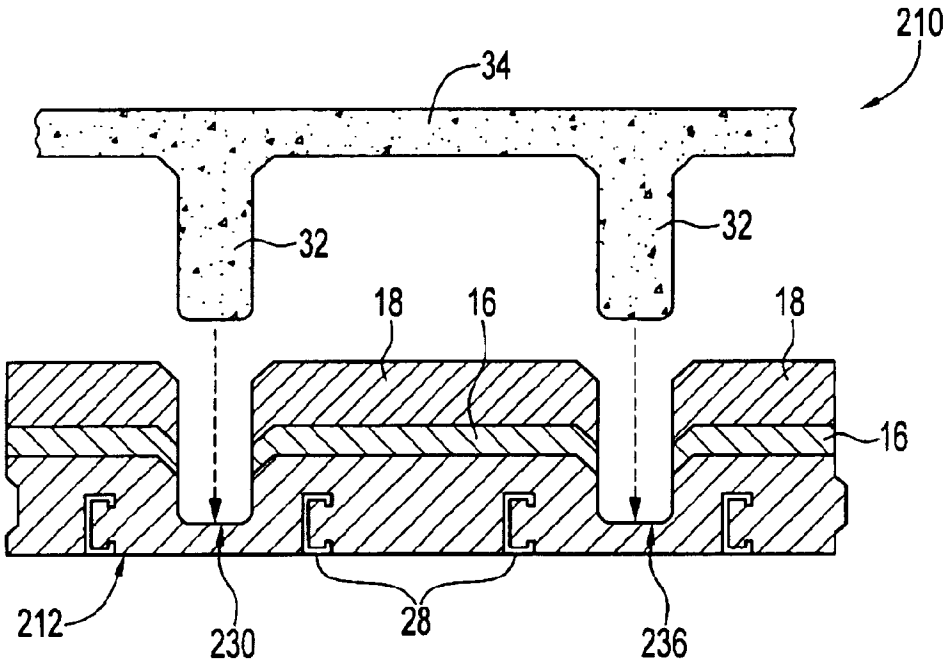
FIG. 5 is an end elevational view of a second embodiment of a form panel, with the hardened concrete deck formed by the panel removed from the panel.

Referring now to FIG. 5, a second embodiment of the form system of the present invention is designated generally at 210 and includes a second embodiment of a form panel 212. The only difference between panel 212 of the second embodiment and panel 12 of the first embodiment, is the shape of slots 230 and 236. Rather than having outwardly sloping side walls as disclosed in the first embodiment, the slots 230 and 236 have vertical side walls. This permits form panel 212 and associated top hats 16 and 18 to be removed from the bottom of the concrete deck 34 and integrated joists 32, as shown in FIG. 5. Preferably, a coating of a foam release agent is sprayed over the top faces of the upper-most top hat 18 (in the version shown in FIG. 5) and within slots 230 and 236. This coating is a material which resists adherence of the hardened concrete with the form panel. In the alternative, a plastic sheet may be positioned over the top of the hats and within the slots, to prevent adherence of the concrete with the panels. Thus, the form system of the present invention may either be designed as a stay-in-place system 10 or a removable system 210, as desired for the particular job.

Figure 6:
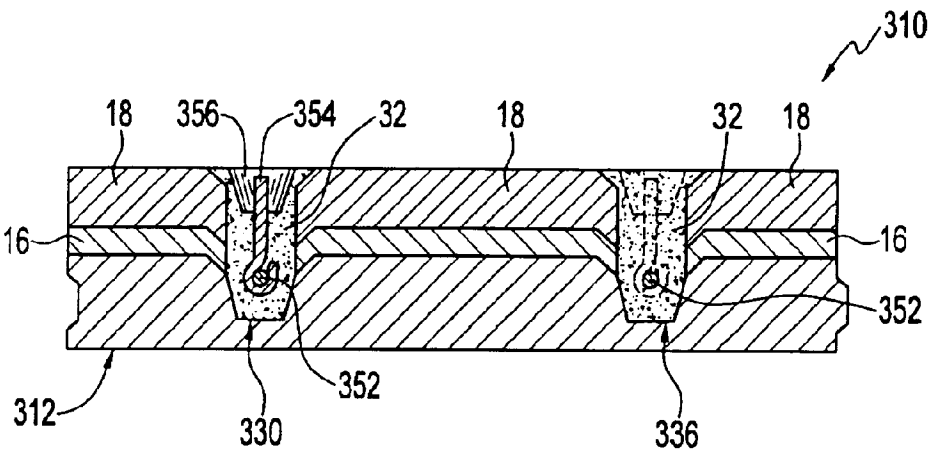
FIG. 6 is an end elevational view of a third embodiment of a form panel, with hardened concrete formed only within the slots, for use as separate structural members.

Referring now to FIG. 6, a third embodiment of the form system of the present invention is designated generally at 310 and includes a third embodiment of a form panel 312. The only difference between panel 312 of the third embodiment and panel 12 of the first embodiment, is the shape of slots 330 and 336. Rather than having outwardly sloping side walls as disclosed in the first embodiment, slots 330 and 336 have inwardly sloping side walls, from the upper ends of the slots to the lower ends. As with the second embodiment, this shape of slots 330 and 336 permits form panel 312 and associated top hats 16 and 18 to be removed from the bottom of a concrete deck in the same fashion as form panels 212 of the second embodiment (shown in FIG. 5).

The inventor herein has also found that the form panels 312 may be used to create concrete joists 32, without the overlying concrete deck shown in FIGS. 1–5. As shown in FIG. 6, concrete is poured into slots 330 and 336 up to the top of the slots, level with the top surface of the uppermost top hats 18. Reinforcement rods 352 are shown extending horizontally through the concrete joists 32, and have vertical lift rods 354 connected thereto. Lift rods 354 may be tide into the reinforcement rods 352, and extend upwardly therefrom. In the preferred form of the invention, the upper end of the lift rod does not project beyond the upper extent of the uppermost top hat 18. A cone-shaped cup 356 is then inserted over the upper end of lift rod 354, to form a cavity in the upper face of joist 32, into which a device may be attached to the lift rod 354 to lift and move the joist 32 and associated form panel 312. A concrete deck may then be poured over the form panels 312 (or 12 or 212) and tied into the joists 32 with lift rods 354. In the alternative, joists 32 may be tied to some other deck or structure using lift rods 354, and not necessarily a concrete deck.

Whereas the invention has been shown and described in connection with the preferred embodiments thereof, many modifications, substitutions and additions may be made which are within the intended broad scope of the appended claims.

What is claimed is:

1. A concrete form system, comprising:

at least a first elongated flat form panel having flat-top and bottom surfaces, first and second ends, and opposing longitudinal side edges;

at least a first elongated slot formed in the top surface of the panel and extending from end to end, parallel to the side edges, said slot dividing the top surface of the panel into upstanding piers; and at least a first elongated flat hat removably secured to a top of each pier, each hat having flat top and bottom surfaces and a width equal to the width of the pier to which it is secured.

2. The concrete form system of claim 1, further comprising a perimeter wall formed around the form system and projecting upwardly beyond the top surface of the hats, such that concrete poured over the form panel and hats will form a flat deck above the top surfaces of the hats with an integrated T-joist formed within the at least one slot.

3. The concrete form system of claim 1, wherein said panel and hats are formed of expanded polystyrene material.

4. The concrete form system of claim 3, wherein said slot is formed with sidewalls that slope outwardly from a top edge to a bottom edge, such that hardened concrete within the slot will prevent the panel from being removed downwardly.

5. A concrete form system, comprising:

at least a first elongated flat form panel having flat top and bottom surfaces, first and second ends, and opposing longitudinal side edges;

at least a first elongated slot formed in the top surface of the panel and extending from end to end, parallel to the side edges, said slot dividing the top surface of the panel into upstanding piers;

each pier having a plurality of hats secured along its length, spaced apart from one another to form transverse slots between the hats on each pier, each hat having flat top and bottom surfaces and a width equal to the width of the pier to which it is secured;

said panel and hats being formed of expanded polystyrene material; and said slot being formed with sidewalls that slope outwardly from a top edge to a bottom edge, such that hardened concrete within the slot will prevent the panel from being removed downwardly.

6. The concrete form system of claim 5, wherein said transverse slots on each pier are aligned with transverse slots on an adjacent pier.

7. The concrete form system of claim 6, wherein said panel slot has upper edges that are beveled inwardly, and wherein said hats have a depending flange along a longitudinal edge that matches the beveled slot edge to nest in the bevel when secured to the panel pier.

8. The concrete form system of claim 7, further comprising at least a second hat secured to the top of the first hat on each pier, the second hat having a length and width equal to the length and width of the first hat, and wherein said perimeter wall projects upwardly beyond a top surface of the second hats.

9. The concrete form system of claim 8, wherein said second hats have a thickness different than a thickness of the first hats.

10. The concrete form system of claim 9, wherein said panel side edges include means for aligning adjacent panels such that the top and bottom surfaces of adjacent panels are flush.

11. The concrete form system of claim 1, wherein said slot is formed with vertical, parallel sidewalls, such that the form panels may be removed downwardly from hardened concrete formed within the slot.

12. The concrete form system of claim 1, wherein said slot is formed with sidewalls that slope inwardly from a top edge to a bottom edge, such that the form panels may be removed downwardly from hardened concrete formed within the slot.

13. The concrete form system of claim 12, wherein upper surfaces of the panel top hats and the sidewalls and bottom of the slot all have a layer of material thereon that resists adherence of concrete thereto.

14. The concrete form system of claim 1, wherein said slot is formed with sidewalls that slope outwardly from a top edge to a bottom edge, such that hardened concrete within the slot will prevent the panel from being removed downwardly.

15. A concrete form system, comprising:

at least a first elongated flat form panel having flat top and bottom surfaces, first and second ends, and opposing longitudinal side edges;

at least a first elongated slot formed in the top surface of the panel and extending from end to end, parallel to the side edges, said slot dividing the top surface of the panel into upstanding piers;

each pier having a plurality of hats secured along its length, spaced apart from one another to form transverse slots between the hats on each pier, each hat having flat top and bottom surfaces and a width equal to the width of the pier to which it is secured.

16. The concrete form system of claim 14, wherein said transverse slots on each pier are aligned with transverse slots on an adjacent pier.

17. A concrete form system, comprising:

at least a first elongated flat form panel having flat top and bottom surfaces, first and second ends, and opposing longitudinal side edges;

at least a first elongated slot formed in the top surface of the panel and extending from end to end, parallel to the side edges, said slot dividing the top surface of the panel into upstanding piers;

at least a first elongated flat hat removably secured to each pier, each hat having flat top and bottom surfaces and a width equal to the width of the pier to which it is secured;

said panel slot having upper edges that are beveled inwardly, and said at least one hat having a depending flange along a longitudinal edge that matches the beveled slot edge to nest in the bevel when secured to the panel pier.

18. A concrete form system, comprising:

at least a first elongated flat form panel having flat top and bottom surfaces, first and second ends, and opposing longitudinal side edges;

at least a first elongated slot formed in the top surface of the panel and extending from end to end, parallel to the side edges, said slot dividing the top surface of the panel into upstanding piers;

at least a first elongated flat hat removably secured to each pier, each hat having flat top and bottom surfaces and a width equal to the width of the pier to which it is secured; and at least a second hat secured to the top of the first hat on each pier, the second hat having a length and width equal to the length and width of the first hat.

19. The concrete form system of claim 1, wherein said panel further includes at least one stiffener stud extending through the length of the panel parallel to and on opposing sides of the at least one longitudinal slot.

20. The concrete form system of claim 1, wherein said panel side edges include means for aligning adjacent panels such that top and bottom surfaces of adjacent panels are flush.

* * * * *